US010403145B2

(12) United States Patent
Deng et al.

(10) Patent No.: US 10,403,145 B2
(45) Date of Patent: Sep. 3, 2019

(54) COLLISON MITIGATION AND AVOIDANCE

(71) Applicant: Ford Global Technologies, LLC, Dearborn, MI (US)

(72) Inventors: Kun Deng, Ann Arbor, MI (US); Nanjun Liu, Ann Arbor, MI (US); Alex Maurice Miller, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 130 days.

(21) Appl. No.: 15/409,641

(22) Filed: Jan. 19, 2017

(65) Prior Publication Data

US 2018/0204460 A1 Jul. 19, 2018

(51) Int. Cl.
*G08G 1/16* (2006.01)
*G08G 1/056* (2006.01)

(52) U.S. Cl.
CPC ..... *G08G 1/166* (2013.01); *G08G 1/056* (2013.01); *G08G 1/163* (2013.01)

(58) Field of Classification Search
CPC ..... G08G 1/166; G08G 1/167; G08G 1/164; G08G 1/165; G08G 1/0112; G08G 1/012; G08G 1/0129; G08G 1/0133
See application file for complete search history.

(56) References Cited

U.S. PATENT DOCUMENTS 7,893,819 B2 * 2/2011 Pfeiffer ..... B60Q 9/008 340/435
8,762,043 B2 6/2014 Eidehall et al.
2001/0054816 A1 * 12/2001 Brambilla ..... B60R 21/0132 280/806
2008/0306666 A1 * 12/2008 Zeng ..... B60Q 9/006 701/70
2009/0143951 A1 6/2009 Takahashi et al.
2009/0192710 A1 * 7/2009 Eidehall ..... B62D 15/0265 701/301
2011/0082623 A1 * 4/2011 Lu ..... B60W 10/06 701/41
2011/0175767 A1 * 7/2011 Tsunekawa ..... G01S 13/42 342/107
2011/0178710 A1 * 7/2011 Pilutti ..... B60T 7/22 701/301
2011/0313665 A1 * 12/2011 Lueke ..... G01S 13/931 701/301
2012/0035846 A1 * 2/2012 Sakamoto ..... B60T 8/17558 701/301
2013/0024075 A1 * 1/2013 Zagorski ..... B60W 30/095 701/46

(Continued)

FOREIGN PATENT DOCUMENTS

CN 103879404 B 8/2016
JP 2014149741 A 8/2014

OTHER PUBLICATIONS

GB Search Report dated Jul. 29, 2018 re GB Appl. No. 1800815.1.

*Primary Examiner* — Redhwan K Mawari
(74) *Attorney, Agent, or Firm* — Frank A. MacKenzie; Bejin Bieneman PLC

(57) ABSTRACT

A distance offset is determined based on a determined time to collision, a relative lateral distance, and a relative longitudinal distance between the target and a host vehicle. A threat estimation is determined based on the distance offset and a distance threshold. A component of the host vehicle are actuated based on the threat estimation.

16 Claims, 5 Drawing Sheets

(56) References Cited

U.S. PATENT DOCUMENTS

| | | | | |
|---|---|---|---|---|
| 2014/0032049 | A1* | 1/2014 | Moshchuk | B62D 15/0265 701/42 |
| 2014/0176714 | A1* | 6/2014 | Li | G08G 1/166 348/148 |
| 2014/0244105 | A1* | 8/2014 | Dariush | B60W 50/0098 701/36 |
| 2015/0106010 | A1* | 4/2015 | Martin | G01C 21/34 701/410 |
| 2015/0151748 | A1 | 6/2015 | Benmimoun et al. | |
| 2015/0353078 | A1* | 12/2015 | Kaminade | G01S 13/06 701/1 |
| 2016/0016561 | A1* | 1/2016 | Lee | B60T 7/22 701/70 |
| 2016/0096473 | A1* | 4/2016 | Park | B60O 9/00 340/436 |
| 2016/0144859 | A1 | 5/2016 | Yoo et al. | |
| 2016/0152234 | A1* | 6/2016 | Kim | B60W 30/09 701/41 |
| 2018/0151073 | A1 | 5/2018 | Minemura et al. | |

* cited by examiner

COLLISON MITIGATION AND AVOIDANCE

BACKGROUND

Vehicle collisions often occur at intersections. Collision mitigation may be difficult and expensive to implement. For example, determining a threat assessment for a target may require data from a plurality of sensors. Furthermore, collision mitigation techniques that may be useful for mitigating rear-end collisions may differ from the techniques useful for crossing-path collisions.

DETAILED DESCRIPTION

A vehicle computer can be programmed to collect data about a target, determine a distance offset based on a determined time to collision, a relative lateral distance, and a relative longitudinal distance between the target and a host vehicle, determine a threat estimation based on the distance offset and a distance threshold, and actuate a component of the host vehicle based on the threat estimation.

By determining the distance offset and the distance threshold for the target, the vehicle computer can determine threat estimations for targets for both rear-end collision and path-crossing scenarios. Furthermore, the vehicle computer can determine the distance offset and the distance threshold for both lateral and longitudinal directions in a vehicle coordinate system, providing additional information about the predicted trajectory of the target. Furthermore, the vehicle computer can determine the time to collision for both the lateral and longitudinal directions and selectively determine the distance offset and the distance threshold for one of the lateral and the longitudinal directions based on the lateral and longitudinal times to collision. Thus, the number of calculations performed by the vehicle computer is reduced, allowing the vehicle computer to perform the threat estimation on the target more quickly.

Figure 1:
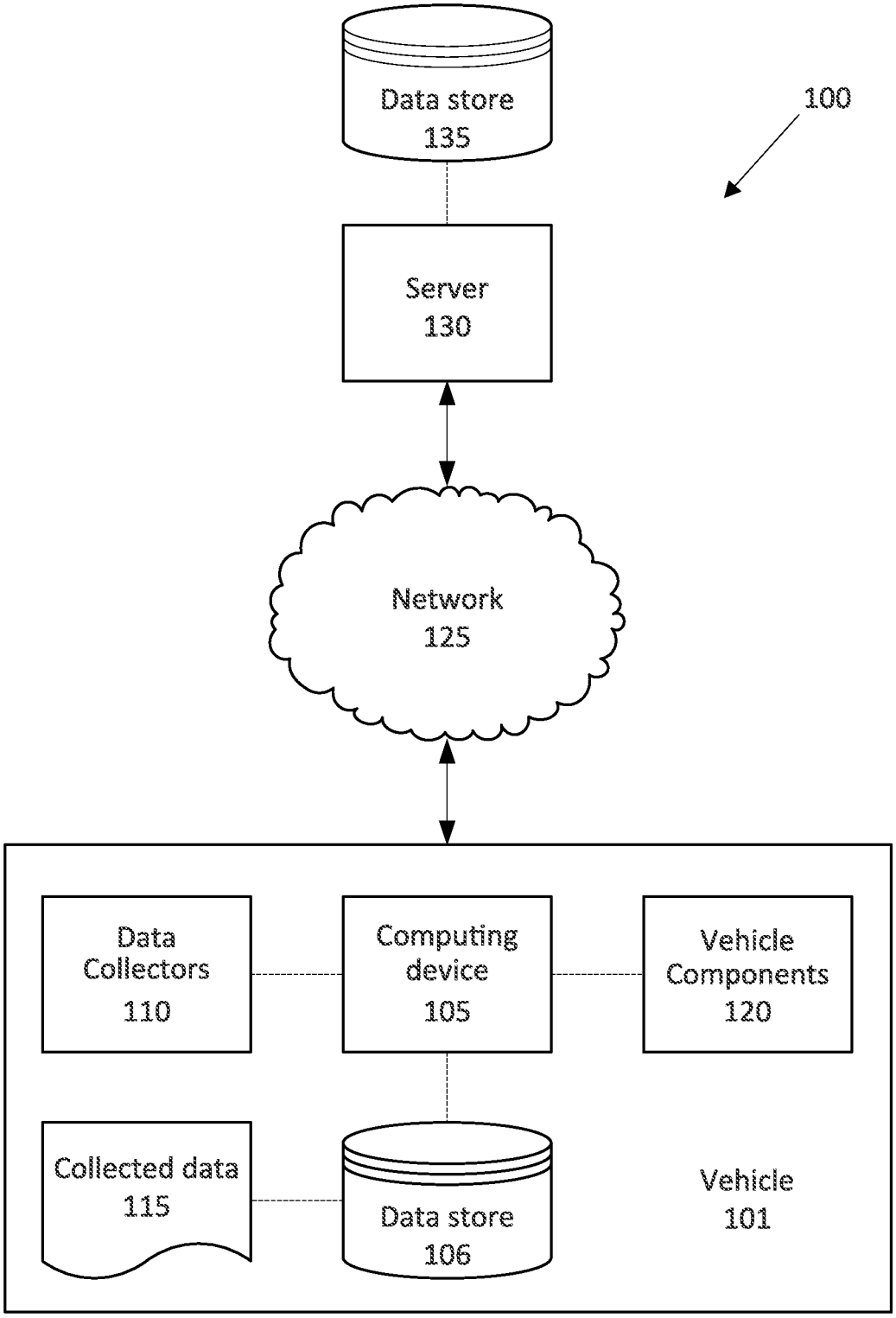
FIG. 1 is a block diagram of an example system to avoid collisions between a host vehicle and a target.

FIG. 1 illustrates a system 100 for collision prevention and mitigation. Unless indicated otherwise in this disclosure, an "intersection" is defined herein as a location where two or more vehicles' current or potential future trajectories cross. Thus, an intersection could be any location on a surface where two or more vehicles could collide, e.g. a road, a driveway, a parking lot, an entrance to a public road, driving paths, etc. Accordingly, an intersection as that term is used herein is determined by identifying a location where two or more vehicles may meet, i.e., collide, rather than by identifying a location with predefined characteristics (e.g., two roads crossing each other) or an "intersection" map label. Such determination uses potential future trajectories of a host vehicle 101 as well as nearby other vehicles and/or other objects.

A computing device 105 in the host vehicle 101 is programmed to receive collected data 115 from one or more sensors 110. For example, vehicle 101 data 115 may include a location of the vehicle 101, a location of a target, etc. Location data may be in a known form, e.g., geo-coordinates such as latitude and longitude coordinates obtained via a navigation system, as is known, that uses the Global Positioning System (GPS). Further examples of data 115 can include measurements of vehicle 101 systems and components, e.g., a vehicle 101 velocity, a vehicle 101 trajectory, etc.

The computing device 105 is generally programmed for communications on a vehicle 101 network, e.g., including a communications (e.g., Controller Area Network or CAN) bus, as is known. Via the network, bus, and/or other wired or wireless mechanisms (e.g., a wired or wireless local area network in the vehicle 101), the computing device 105 may transmit messages to various devices in a vehicle 101 and/or receive messages from the various devices, e.g., controllers, actuators, sensors, etc., including sensors 110. Alternatively or additionally, in cases where the computing device 105 actually comprises multiple devices, the vehicle network may be used for communications between devices represented as the computing device 105 in this disclosure. In addition, the computing device 105 may be programmed for communicating with the network 125, which, as described below, may include various wired and/or wireless networking technologies, e.g., cellular, Bluetooth, wired and/or wireless packet networks, etc.

The data store 106 may be of any known type, e.g., hard disk drives, solid state drives, servers, or any volatile or non-volatile media. The data store 106 may store the collected data 115 sent from the sensors 110.

Sensors 110 may include a variety of devices. For example, as is known, various controllers in a vehicle 101 may operate as sensors 110 to provide data 115 via the vehicle 101 network or bus, e.g., data 115 relating to vehicle speed, acceleration, position, subsystem and/or component status, etc. Further, other sensors 110 could include cameras, motion detectors, etc., i.e., sensors 110 to provide data 115 for evaluating a location of a target, projecting a path of a target, evaluating a location of a roadway lane, etc. The sensors 110 could also include short range radar, long range radar, LIDAR, and/or ultrasonic transducers.

Collected data 115 may include a variety of data collected in a vehicle 101. Examples of collected data 115 are provided above, and moreover, data 115 are generally collected using one or more sensors 110, and may additionally include data calculated therefrom in the computing device 105, and/or at the server 130. In general, collected data 115 may include any data that may be gathered by the sensors 110 and/or computed from such data.

The vehicle 101 may include a plurality of vehicle components 120. As used herein, each vehicle component 120 includes one or more hardware components adapted to perform a mechanical function or operation—such as moving the vehicle, slowing or stopping the vehicle, steering the vehicle, etc. Non-limiting examples of components 120 include a propulsion component (that includes, e.g., an internal combustion engine and/or an electric motor, etc.), a transmission component, a steering component (e.g., that may include one or more of a steering wheel, a steering rack, etc.), a brake component, a park assist component, an adaptive cruise control component, an adaptive steering component, and the like.

The computing device 105 may actuate the components 120 to, e.g., brake and/or slow and/or stop the vehicle 101, to avoid targets, etc. The computing device 105 may be programmed to operate some or all of the components 120 with limited or no input from a human operator, i.e., the computing device 105 may be programmed to operate the components 120. When the computing device 105 operates the components 120, the computing device 105 can ignore input from the human operator with respect to components 120 selected for control by the computing device 105, which provides instructions, e.g., via a vehicle 101 communications bus and/or to electronic control units (ECUs) as are known, to actuate vehicle 101 components, e.g., to apply brakes, change a steering wheel angle, etc. For example, if the human operator attempts to turn a steering wheel during steering operation, the computing device 105 may ignore the movement of the steering wheel and steer the vehicle 101 according to its programming.

When the computing device 105 operates the vehicle 101, the vehicle 101 is an "autonomous" vehicle 101. For purposes of this disclosure, the term "autonomous vehicle" is used to refer to a vehicle 101 operating in a fully autonomous mode. A fully autonomous mode is defined as one in which each of vehicle 101 propulsion (typically via a powertrain including an electric motor and/or internal combustion engine), braking, and steering are controlled by the computing device 105 and not a human operator. A semi-autonomous mode is one in which at least one of vehicle 101 propulsion (typically via a powertrain including an electric motor and/or internal combustion engine), braking, and steering are controlled at least partly by the computing device 105 as opposed to a human operator.

The system 100 may further include a network 125 connected to a server 130 and a data store 135. The computer 105 may further be programmed to communicate with one or more remote sites such as the server 130, via the network 125, such remote site possibly including a data store 135. The network 125 represents one or more mechanisms by which a vehicle computer 105 may communicate with a remote server 130. Accordingly, the network 125 may be one or more of various wired or wireless communication mechanisms, including any desired combination of wired (e.g., cable and fiber) and/or wireless (e.g., cellular, wireless, satellite, microwave, and radio frequency) communication mechanisms and any desired network topology (or topologies when multiple communication mechanisms are utilized). Exemplary communication networks include wireless communication networks (e.g., using Bluetooth, IEEE 802.11, vehicle-to-vehicle (V2V) such as Dedicated Short Range Communications (DSRC), etc.), local area networks (LAN) and/or wide area networks (WAN), including the Internet, providing data communication services.

Figure 2A:
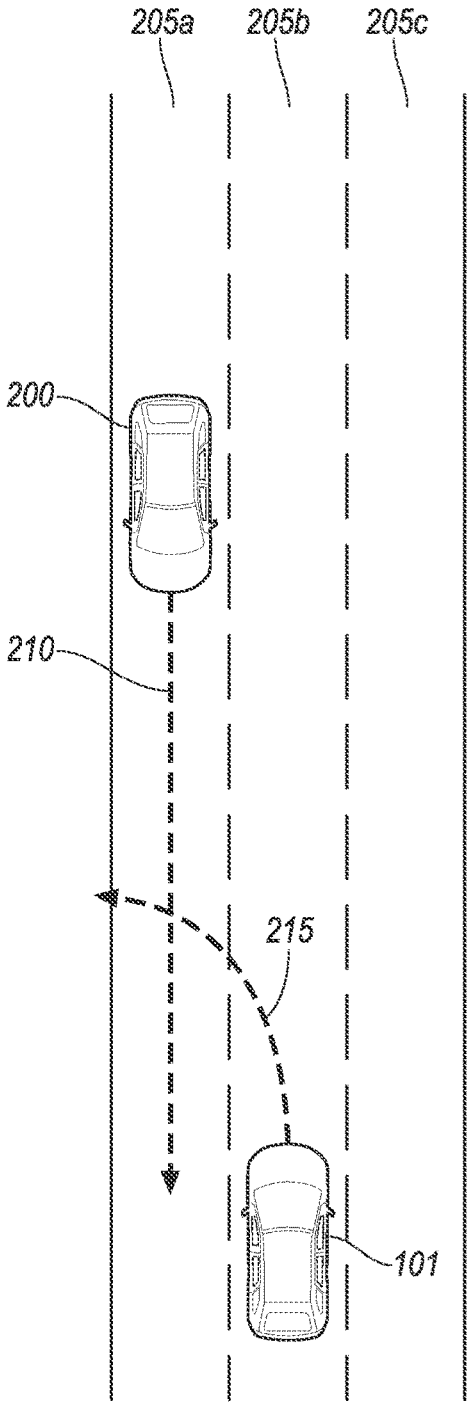
FIG. 2A illustrates an example intersection between the host vehicle and the target.
Figure 2B:
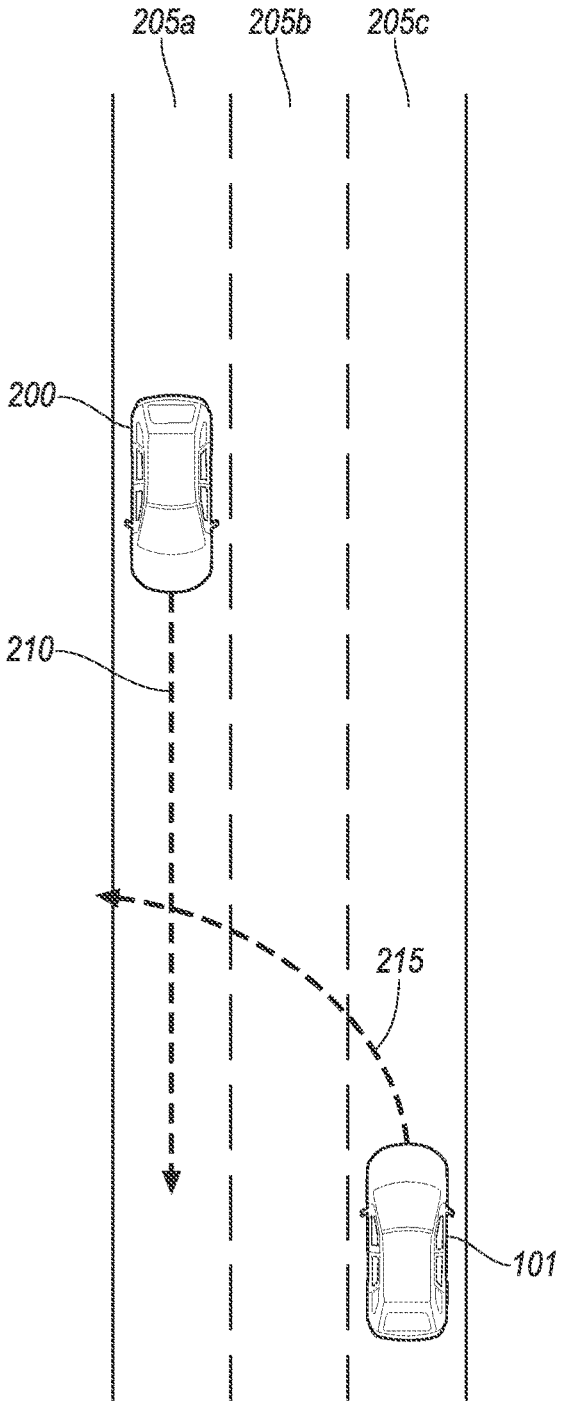
FIG. 2B illustrates an example intersection between the host vehicle and the target.

FIGS. 2A and 2B illustrate example intersections including a host vehicle 101 and a target 200. The target 200 is illustrates as a target vehicle 200 in the examples of FIGS. 2A-2B, and the target 200 can be an obstacle with which the host vehicle 101 could collide, e.g., a roadway sign, a guard rail, a tree, etc. The host vehicle 101 can move in a roadway lane 205, and the target 200 can move in a different roadway lane 205. In the examples of FIGS. 2A-2B, the roadway has three roadway lanes 205*a*, 205*b*, 205*c*, and the roadway can have a different number of roadway lanes 205. The target 200 can move along a trajectory 210.

As shown in FIGS. 2A-2B, the host vehicle 101 can perform a turn 215 from the current roadway lane 205 and cross the trajectory 210 of the target 200. In the example of FIG. 2A, the host vehicle 101 is in the roadway lane 205*b*, and the target 200 is in the roadway lane 205*a*, i.e., the host vehicle 101 is offset from the target 200 by one roadway lane 205. In the example of FIG. 2B, the host vehicle 101 is in the roadway lane 205*c* and the target 200 is in the roadway lane 205*a*, i.e., the host vehicle 101 is offset from the target 200 by two roadway lanes 205. Based on the number of roadway lanes 205 between the host vehicle 101 and the target 200, the host vehicle 101 can require more time to complete the turn 215 and pass the trajectory 210 of the target 200. Thus, the computing device 105 can determine a threat number of a potential collision with the target 200 based on the turn 215 that the host vehicle 101 will perform.

FIGS. 2A-2B illustrate the host vehicle 101 crossing a path of the target 200, i.e., a path-crossing scenario. Alternatively or additionally, the following equations can be used when the host vehicle 101 is approaching a rear end of the target 200, i.e., a rear-end collision scenario. Thus, the computing device 105 can determine a threat assessment for the target 200 in both path-crossing and rear-end collision scenarios.

Figure 3:
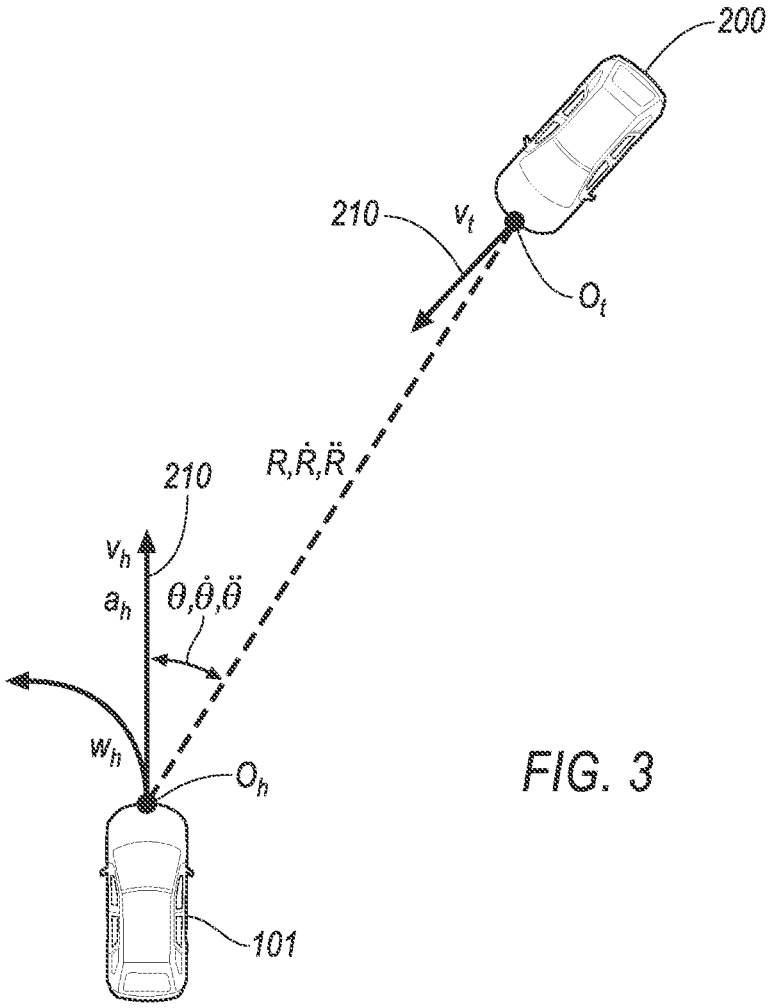
FIG. 3 is an example diagram of measurements taken by the host vehicle in polar coordinates between the host vehicle and the target.

FIG. 3 illustrates data 115 collected by the sensors 110 of the host vehicle 101 and the target 200 and values determined by the computing device 105 based on the data 115. In this illustration, the data 115 include data 115 concerning vehicle 101, 200 trajectories according to data 115 provided with reference to a polar coordinate system having a point of origin on the host vehicle 101, e.g., as shown in FIG. 3. The target 200 is moving according to the trajectory 210, as described above. The host vehicle 101 is moving according to a trajectory 210. The trajectories 210 indicate where the host vehicle 101 and the target 200 would move if the host vehicle 101 and the target 200 continued at their respective velocities without turning. The host vehicle 101 can define the coordinate system with an origin $O_h$ at a center point of a front end of the host vehicle 101. The computing device 105 can use the origin $O_h$ to define the position, speed, and acceleration of the host vehicle 101 and the target 200. One or more sensors 110 may provide data 115 according to the polar coordinates. In the example of FIG. 3, the trajectory 210 of the target 200 shows that the target 200 is moving toward the host vehicle 101 as in, e.g., a path-crossing scenario. The trajectory 210 of the target 200 can show that the target 200 is moving away from the host vehicle 101 as in, e.g., a rear end collision scenario.

A range R between the host vehicle 101 and the target 200 is defined as the shortest straight line between the origin $O_h$ of the host vehicle 101 and an origin $O_t$ of the target 200, e.g., measured in meters. The origin $O_t$ of the target 200 is defined as a center point of a front end of the target 200. A range rate $\dot{R}$ is a time rate of change of the range (i.e., dR/dt) and range acceleration $\ddot{R}$ is a time rate of change of the range rate (i.e., $d^2R/dt^2$). The range R is thus the shortest absolute distance between the host vehicle 101 and the target 200. Because the host vehicle 101 is turning, the range R may not always align with the trajectory 210 of the target 200. That is, the trajectory 210 of the target 200 may define an angle (not numbered in FIG. 3) with a line defined by the range R.

An azimuth θ is defined as an angle defined between the trajectory 210 of the host vehicle 101 and the line defined by the range R, measured in radians. An azimuth rate $\dot{\theta}$ is the time rate of change of the azimuth θ (i.e., dθ/dt) and an azimuth acceleration $\ddot{\theta}$ is the time rate of change of the azimuth rate $\dot{\theta}$ (i.e., $d^2\theta/dt^2$).

When the host vehicle 101 is in the turn 215, the direction of travel of the host vehicle 101 changes. The change is the direction of travel is defined as a yaw rate $w_h$, measured in radians per second. The yaw rate $w_h$ can be used by the computing device 105 to determine whether the target 200 will collide with the host vehicle 101. That is, because the host vehicle 101 is turning away from the current trajectory 210, the host vehicle 101 can avoid the target 200 even if, at a certain time, the direction of travel of the target 200 indicates a potential collision with the host vehicle 101.

A host velocity $v_h$ is a speed of the host vehicle 101 along the trajectory 210, measured in meters per second. A host acceleration $a_h$ is the time rate of change of the host vehicle 101 (i.e., $dv_h/dt$). The host velocity $v_h$ and the host acceleration $a_h$ are based on the host vehicle 101 following the trajectory 210. Thus, as the host vehicle 101 turns, the host velocity $v_h$ and the host acceleration $a_h$ will change with the trajectory 210. A target velocity $v_t$ is a speed of the target 200 along the trajectory 210, measured in meters per second.

Figure 4:
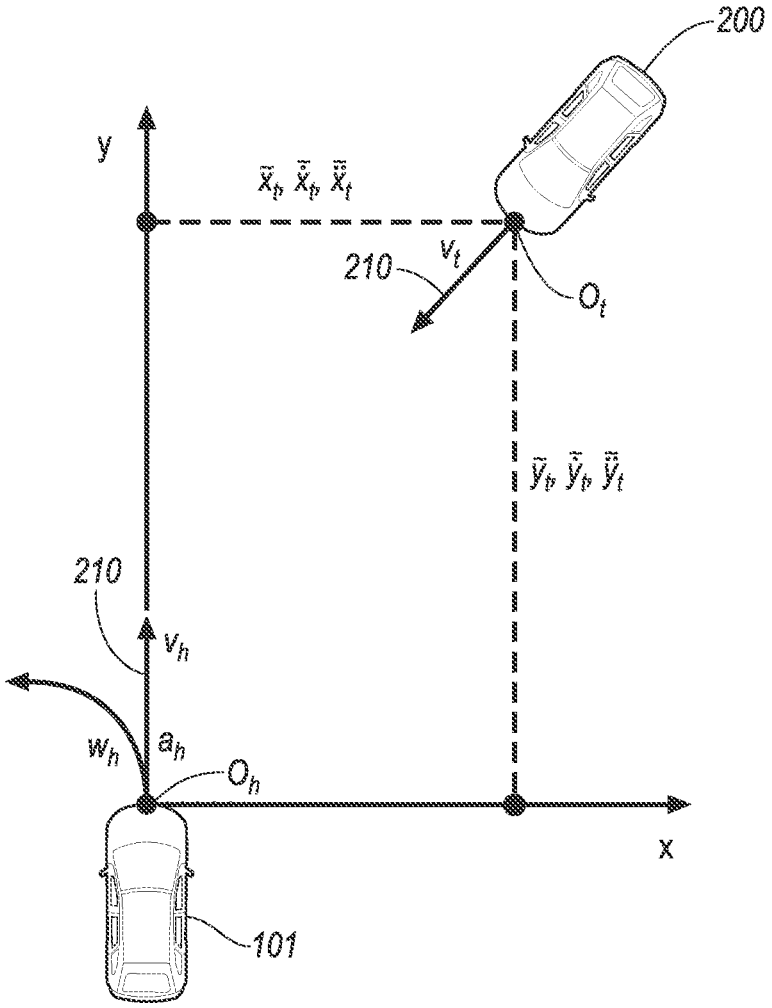
FIG. 4 is an example diagram of mapping the measurements of FIG. 3 into rectangular coordinates.

FIG. 4 illustrates the host vehicle 101 and the target 200 in a rectangular coordinate system having a point of origin $O_h$ of the host vehicle 101. The rectangular coordinate system can be used to define orthogonal directions: a lateral direction, designated with the variable x, and a longitudinal direction, designated with the variable y. Rather than using the polar coordinates as in FIG. 3, the computing device 105 can predict the position, speed, and acceleration of the host vehicle 101 and the target vehicle according to the rectangular coordinates. Specifically, the computing device 105 can determine a position, speed, and acceleration in a longitudinal direction, and a position, speed, and acceleration in a lateral direction, as described further below. Furthermore, one or more sensors 110 can collect data 115 in the rectangular coordinates, and the computing device 105 can convert the data 115 in polar coordinates to values in the rectangular coordinates using the range R and the azimuth θ.

A lateral position $\tilde{x}_t$ of the target 200 is a distance in the lateral direction x of the target 200 relative to the host vehicle 101. A lateral velocity $\dot{\tilde{x}}_t$ of the target 200 is a time rate of change of the lateral position $\tilde{x}_t$, i.e., $d\tilde{x}_t/dt$. A lateral acceleration $\ddot{\tilde{x}}_t$ of the target 200 is a time rate of change of the lateral velocity $\dot{\tilde{x}}_t$, i.e., $d\dot{\tilde{x}}_t/dt$.

A longitudinal position $\tilde{y}_t$ of the target 200 is a distance in the longitudinal direction y of the target 200 relative to the host vehicle 101. A longitudinal velocity $\dot{\tilde{y}}_t$ of the target 200 is a time rate of change of the longitudinal position $\tilde{y}_t$, i.e., $d\tilde{y}_t/dt$. A longitudinal acceleration $\ddot{\tilde{y}}_t$ of the target 200 is a time rate of change of the longitudinal velocity $\dot{\tilde{y}}_t$, i.e., $d\dot{\tilde{y}}_t/dt$.

The values described above can be functions of time t, measured in seconds. The computing device 105 can predict the path of the host vehicle 101 and the target 200 over a predetermined time period T. The following equations solve for the time period T that results in a time to collision (TTC) between the host vehicle 101 and the target 200.

The computing device 105 can predict the longitudinal distance $\tilde{y}_t$ of the target 200. The longitudinal distance $\tilde{y}_t$ of the target 200 with respect to the host vehicle 101 predicted at time (t+T) is given as:

$$\tilde{y}_t(t+T) = \frac{a_h(t)w_h^2(t)}{8} * T^4 + \frac{v_h(t)w_h^2(t)}{6} * T^3 + \frac{\ddot{\tilde{y}}_t(t)}{2} * T^2 + \dot{\tilde{y}}_t(t) * T + \tilde{y}_t(t) \tag{1}$$

The relative lateral distance $\tilde{x}_t$ of the target 200 with respect to the host vehicle 101 predicted at time (t+T) is given as:

$$\tilde{x}_t(t+T) = \frac{a_h(t)w_h(t)}{3} * T^3 + \frac{v_h(t)w_h(t) + \ddot{\tilde{x}}_t(t)}{2} * T^2 + \dot{\tilde{x}}_t(t) * T + \tilde{x}_t(t) \tag{2}$$

The longitudinal time to collision ($TTC_{long}$) is defined as the time period T when the host vehicle 101 and the target 200 reach the same longitudinal position, i.e. the relative longitudinal distance $\tilde{y}_t$ between the target 200 and the host vehicle 101 is equal to zero. Thus, at any time t, $TTC_{long}$ satisfies the equation $\tilde{y}_t(t+TTC_{long}(t))=0$. More specifically, $TTC_{long}$ is obtained as the smallest positive real root to the following polynomial equation:

$$\frac{a_h(t)w_h^2(t)}{8} * T^4 + \frac{v_h(t)w_h^2(t)}{6} * T^3 + \frac{\ddot{\tilde{y}}_t(t)}{2} * T^2 + \dot{\tilde{y}}_t(t) * T + \tilde{y}_t(t) = 0 \tag{3}$$

The lateral TTC ($TTC_{lat}$) is defined as the time period T when the host vehicle 101 and the target 200 reach the same lateral position, i.e. the relative lateral distance $\tilde{x}_t$ between target and host is equal to zero. Thus, at any time instance t, $TTC_{lat}(t)$ satisfies the equation $\tilde{x}_t(t+TTC_{lat}(t))=0$. More specifically, $TTC_{lat}$ is obtained as the smallest positive real root to the following polynomial:

$$\frac{a_h(t)w_h(t)}{3} * T^3 + \frac{v_h(t)w_h(t) + \ddot{\tilde{x}}_t(t)}{2} * T^2 + \dot{\tilde{x}}_t(t) * T + \tilde{x}_t(t) = 0 \tag{4}$$

By substituting calculated $TTC_{lat}(t)$ into Eqn. (1), we obtain the predicted longitudinal distance offset PredLongOff(t) at time t as:

$$PredLongOff(t) \triangleq \tilde{y}_t(t + TTC_{lat}(t)) = \frac{a_h(t)w_h^2(t)}{8} * TTC_{lat}^4(t) + \frac{v_h(t)w_h^2(t)}{6} * TTC_{lat}^3(t) + \frac{\ddot{\tilde{y}}_t(t)}{2} * TTC_{lat}^2(t) + \dot{\tilde{y}}_t(t) * TTC_{lat}(t) + \tilde{y}_t(t) \tag{5}$$

By substituting calculated $TTC_{long}(t)$ into Eqn. (2), we obtain the predicted lateral distance offset PredLatOff(t) at time t as:

$$PredLatOff(t) \triangleq \tilde{x}_t(t + TTC_{long}(t)) = \frac{a_h(t)w_h(t)}{3} * TTC_{long}^3(t) + \frac{v_h(t)w_h(t) + \ddot{\tilde{x}}_t(t)}{2} * TTC_{long}^2(t) + \dot{\tilde{x}}_t(t) * TTC_{long}(t) + \tilde{x}_t(t) \tag{6}$$

where $a_h(t)$, $v_h(t)$, $w_h(t)$, $\ddot{\tilde{x}}_t(t)$, $\dot{\tilde{x}}_t(t)$, $\tilde{x}_t(t)$ are measurement data 115 of the host vehicle 101 and the target 200, as described above, and $TTC_{long}(t)$ is the longitudinal time to collision.

Based on the lateral time to collision $TTC_{lat}$ and the longitudinal time to collision $TTC_{long}$, the computing device 105 can determine a longitudinal indicator $F_{long}$. The longitudinal indicator is a Boolean measure of whether the target 200 will reach the position of the host vehicle 101 in the lateral direction x or the longitudinal direction y. That is, $$TTC_{long}(t) \leq TTC_{lat}(t) \stackrel{\text{def}}{=} F_{long}(t)=1$$

$$TTC_{long}(t) > TTC_{lat}(t) \stackrel{\text{def}}{=} F_{long}(t)=0 \tag{7}$$

When $F_{long}(t)=1$, the relative longitudinal distance $\tilde{y}_t$ between the host vehicle 101 and the target 200 becomes zero earlier than the relative lateral distance $\tilde{x}_t$. When $F_{long}(t)=0$, the relative lateral distance $\tilde{x}_t$ between the host vehicle 101 and the target 200 becomes zero earlier than the relative longitudinal distance $\tilde{y}_t$.

The computing device 105 can use an adaptive threshold function f(t) to determine a distance threshold. The distance threshold can be used to determine if the predicted relative lateral and longitudinal distances $\tilde{x}_t$, $\tilde{y}_t$ can trigger a potential collision between the host vehicle 101 and the target 200. The adaptive threshold function $f(t_0)$ for a given time $t_0$ is defined as:

$$f(t_0) = \frac{a}{2}\left(\frac{(b-t_0)}{\sqrt{(b-t_0)^2+c^2}}+1\right) \tag{8}$$

where a>0, b>0, and c>0 and are tunable parameters (i.e., values that can be changed, e.g., according to empirical testing and/or simulations), e.g., a=2.5, b=3, and c=1. In the function, a represents a predetermined maximum threshold for the predicted longitudinal and lateral distance offsets PredLongOff, PredLatOff, b represents a predetermined mean threshold for the longitudinal and lateral times to collision $TTC_{long}$, $TTC_{lat}$, and c represents a predetermined decay rate of the threshold function f(t). The parameters can be predetermined for longitudinal thresholds $a_{long}$, $b_{long}$, $c_{long}$ and lateral thresholds $a_{lat}$, $b_{lat}$, $c_{lat}$.

A longitudinal distance threshold LongDistThresh(t) is obtained by substituting $TTC_{lat}(t)$ into the threshold function f(t):

$$LongDistThresh(t) \stackrel{\Delta}{=} f(TTC_{lat}(t)) = \frac{a_{long}}{2} * \left(\frac{(b_{long}-TTC_{lat}(t))}{\sqrt{(b_{long}-TTC_{lat}(t))^2+c_{long}^2}}+1\right) \tag{9}$$

A lateral distance threshold LatDistThresh(t) is obtained by substituting $TTC_{long}(t)$ into the threshold function f(t):

$$LatDistThresh(t) \stackrel{\Delta}{=} f(TTC_{long}(t)) = \frac{a_{lat}}{2} * \left(\frac{(b_{lat}-TTC_{long}(t))}{\sqrt{(b_{lat}-TTC_{long}(t))^2+c_{lat}^2}}+1\right) \tag{10}$$

The computing device 105 can determine a collision factor $F_{collision}(t)$ based on the distance thresholds, the distance offsets, and the longitudinal factor described above. The collision factor $F_{collision}(t)$ is a Boolean measure of whether the respective distance offset is less than the distance threshold, i.e., the collision factor $F_{collision}(t)$ indicates whether a collision is likely at a specific time t. The collision factor $F_{collision}(t)$ can be defined as follows:

$$F_{collision}(t)=1:|PredLongOff(t)| \leq LongDistThresh(t)$$

$$F_{collision}(t)=1:|PredLatOff(t)| \leq LatDistThresh(t)$$

$$F_{collision}(t)=0:|PredLongOff(t)| > LongDistThresh(t)$$

$$F_{collision}(t)=0:|PredLatOff(t)| > LatDistThresh(t) \tag{11}$$

The computing device 105 determines the collision factor $F_{collision}(t)$ based on the predicted lateral distance offset PredLatOff(t) when the longitudinal indicator $F_{long}(t)=1$. The computing device 105 determines the collision factor $F_{collision}(t)$ based on the predicted longitudinal distance offset PredLongOff(t) when the longitudinal indicator $F_{long}(t)=0$.

The computing device 105 can determine a braking threat number BTN. The braking threat number BTN is a measure of a change in an acceleration of the host vehicle 101 to allow one of the host vehicle 101 to stop or the target 200 to pass the host vehicle 101. At a time t, the braking threat number for the host vehicle 101 $BTN_h(t)$ can be calculated as $$BTN_h(t) = \min\left(\frac{v_h(t)}{F_{long}(t)*TTC_{long}(t)+(1-F_{long}(t))*TTC_{lat}(t)} * \frac{1}{decel_h^{max}}, 1\right) \tag{12}$$

where $v_h(t)$ is the host vehicle velocity, $TTC_{long}(t)$ is the longitudinal time to collision, $TTC_{lat}(t)$ is the lateral time to collision, $F_{long}(t)$ is the longitudinal indicator, as described above, and $decel_h^{max}$ is a user-specific parameter specifying a maximum achievable deceleration magnitude due to the host vehicle 101 braking maneuver, e.g., $decel_h^{max}=8\ m/s^2$ for a typical vehicle 101 driving on a dry road.

At a time t, the braking threat number for the target 200 $BTN_t(t)$ can be calculated as $$BTN_t(t) = \min\left(\frac{v_t(t)}{F_{long}(t)*TTC_{long}(t)+(1-F_{long}(t))*TTC_{lat}(t)} * \frac{1}{decel_t^{max}}, 1\right) \tag{13}$$

where $v_t(t)$ is the target vehicle velocity, $TTC_{long}(t)$ is the longitudinal time to collision, $TTC_{lat}(t)$ is the lateral time to collision, $F_{long}(t)$ is a longitudinal indicator, and $decel_t^{max}$ is a user-specific parameter specifying the maximum achievable deceleration magnitude due to the target 200 braking and/or stopping maneuver, e.g., $decel_t^{max}=4\ m/s^2$ for a typical target vehicle 200 driving on a dry road.

The computing device 105 can determine a steering threat number STN. The STN is a measure of a change in lateral acceleration to allow one of the host vehicle 101 and the target 200 to clear a crossing zone and/or to steer the host vehicle 101 around a front end or a rear end of the target 200. At a time t, a steering threat number for the host vehicle 101 $STN_h(t)$ and a steering threat number for the target 200 $STN_t(t)$ can be calculated as:

$$STN_h(t) = \min\left(\frac{2*\max(LatDistThresh(t)-|PredLatOff(t)|, 0)}{(TTC_{long}(t))^2} * \frac{v_h(t)}{accel_{lat,h}^{max} * \bar{v}_{lat,h}^{nom}}, 1\right) \tag{14}$$

-continued $$STN_t(t) = \min\left(\frac{2*\max(LatDistThresh(t) - |PredLatOff(t)|, 0)}{(TTC_{long}(t))^2} * \frac{v_t(t)}{accel_{lat,t}^{max} * \bar{v}_{lat,t}^{nom}}, 1\right) \quad (15)$$

where $v_h(t)$ and $v_t(t)$ are the host vehicle 101 and target 200 velocity, respectively, $TTC_{long}(t)$ is the longitudinal time to collision, LatDistThresh(t) is the lateral distance threshold, PredLatOff(t) is the predicted lateral offset, and $accel_{lat,h}^{max}$ and $accel_{lat,t}^{max}$ are user-specific parameters specifying the maximum achievable lateral acceleration at a user-specific nominal lateral speed $\bar{v}_{lat,h}^{nom}$ and $\bar{v}_{lat,t}^{nom}$ due to the host vehicle 101 or target 200 steering maneuver, e.g., $accel_{lat,h}^{max}=2.5$ m/s$^2$, $accel_{lat,t}^{max}=1.5$ m/s$^2$, $\bar{v}_{lat,h}^{nom}=4.5$ m/s, and $\bar{v}_{lat,t}^{nom}=13.5$ m/s.

The computing device 105 can determine an acceleration threat number ATN. The ATN is a measure of a specific longitudinal acceleration to allow one of the host vehicle 101 and the target 200 to pass the other of the host vehicle 101 and the target 200. At a time t, an acceleration threat number for the host vehicle 101 $ATN_h(t)$ and an acceleration threat number for the target 200 $ATN_t(t)$ can be calculated as:

$$ATN_h(t) = \min\left(\frac{2*\max(LongDistThresh(t) - |PredLongOff(t)|, 0)}{(TTC_{lat}(t))^2} * \frac{v_h(t)}{accel_{long,h}^{max} * \bar{v}_{long,h}^{nom}}, 1\right) \quad (16)$$

$$ATN_t(t) = \min\left(\frac{2*\max(LongDistThresh(t) - |PredLongOff(t)|, 0)}{(TTC_{lat}(t))^2} * \frac{v_t(t)}{accel_{long,t}^{max} * \bar{v}_{long,t}^{nom}}, 1\right) \quad (17)$$

where $v_h(t)$ and $v_t(t)$ are the host vehicle 101 and a target 200 velocity, respectively, $TTC_{lat}(t)$ is the lateral time to collision, LongDistThresh(t) is the predicted longitudinal distance threshold, PredLongOff(t) is the predicted longitudinal offset, and $accel_{long,h}^{max}$ and $accel_{long,t}^{max}$ are user-specific parameters specifying the maximum achievable longitudinal acceleration at a user-specific nominal longitudinal speed $\bar{v}_{long,h}^{nom}$ or $\bar{v}_{long,t}^{nom}$ due to the host vehicle 101 and the target 200 accelerating maneuver, e.g., $accel_{long,h}^{max}=4$ m/s$^2$, $accel_{long,t}^{max}=2$ m/s$^2$, $\bar{v}_{long,h}^{nom}=4.5$ m/s, and $\bar{v}_{long,t}^{nom}=13.5$ m/s.

The computing device 105 can determine a threat number TN. The threat number TN(t) is the minimum value of host vehicle 101 and target 200 threat numbers multiplied by the collision indicator $F_{collision}$:

$$TN(t)=F_{collision}(t)*\min(BTN_h(t), BTN_t(t), STN_h(t), STN_t(t), ATN_h(t), ATN_t(t)) \quad (18)$$

The computing device 105 can actuate one or more vehicle components 120 based on the threat number. For example, if the threat number is above 0.7, the computing device 105 can actuate a brake 120 to decelerate the host vehicle 101, e.g., to −6.5 meters per second squared (m/s$^2$). In another example, if the threat number is above 0.4 but less than or equal to 0.7, the computing device 105 can actuate the brake 120 to, e.g., a deceleration of −2.0 m/s$^2$. In another example, if the threat number is greater than 0.2 but less than or equal to 0.4, the computing device 105 can display a visual warning on a vehicle 101 HMI and/or play an audio warning over a speaker.

Figure 5:
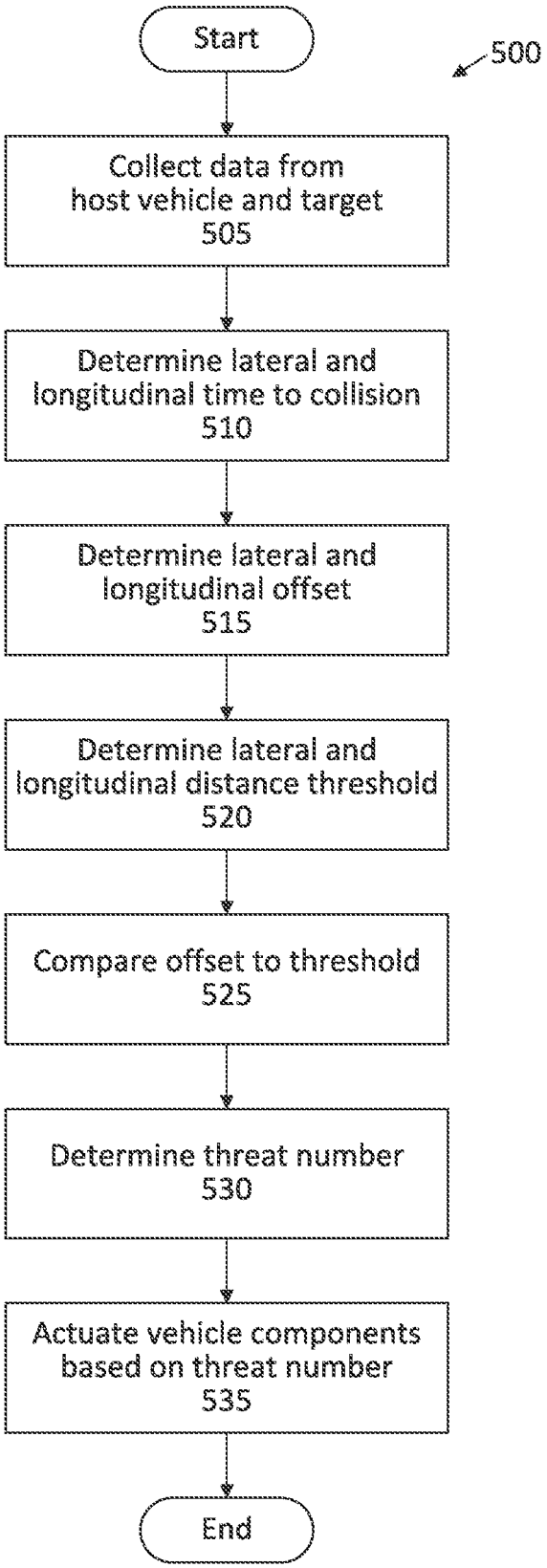
FIG. 5 is a block diagram of an example process for avoiding collisions between the host vehicle and the target.

FIG. 5 illustrates an example process 500 for operating the vehicle 101 in a manner for collision avoidance. The process 500 begins in a block 505 in which the computing device 105 actuates the sensors 110 to collect data 115 about the host vehicle 101 and the target 200. As described above, the computing device 105 can collect data 115 about the target 200 position, speed, trajectory, etc. Specifically, the computing device 105 can determine the range R and the azimuth θ between the host vehicle 101 and the target 200.

Next, in a block 510, the computing device 105 determines the longitudinal time to collision $TTC_{long}$ and the lateral time to collision $TTC_{lat}$ between the host vehicle 101 and the target 200. As described above, the longitudinal time to collision $TTC_{long}$ predicts the time that the host vehicle 100 and the target 200 reach the same longitudinal position. The lateral time to collision $TTC_{lat}$ predicts the time that the host vehicle 101 and the target 200 reach the same lateral position.

Next, in a block 515, the computing device 105 determines the predicted longitudinal distance offset PredLongOff and the predicted lateral distance offset PredLatOff. As described above, the computing device 105 converts the polar coordinates that define the target 200 position relative to the host vehicle 101 to rectangular coordinates. According to the rectangular coordinates, the computing device 105 can determine the distance offsets in the longitudinal and lateral directions, as described above.

Next, in a block 520, the computing device 105 determines the longitudinal distance threshold LongDistThresh and the lateral distance threshold LatDistThresh. As described above, the longitudinal distance threshold LongDistThresh and the lateral distance threshold LatDistThresh are based on an adaptive threshold function f(t) that can be used to determine if the predicted relative lateral and longitudinal distances $\tilde{x}_t$, $\tilde{y}_t$ can trigger a potential collision between the host vehicle 101 and the target 200.

Next, in a block 525, the computing device 105 compares the predicted longitudinal offset PredLongOff to the longitudinal distance threshold LongDistThresh and/or the predicted lateral offset PredLatOff to the lateral distance threshold LatDistThresh. When the longitudinal time to collision $TTC_{long}$ is less than or equal to the lateral time to collision $TTC_{lat}$, the computing device 105 can compare the predicted longitudinal offset PredLongOff to the longitudinal distance threshold LongDistThresh to determine the collision factor $F_{collision}$. When the longitudinal time to collision $TTC_{long}$ is greater than the lateral time to collision $TTC_{lat}$, the computing device 105 can compare the predicted lateral offset PredLatOff to the lateral distance threshold LatDistThresh to determine the collision factor $F_{collision}$.

Next in a block 530, the computing device 105 determines the threat number. As described above, the threat number is a measure of the probability of the collision between the host vehicle 101 and the target 200. The threat number can be a brake threat number BTN, an acceleration threat number ATN, or a steering threat number STN, as described above. The threat number can be based on the collision factor $F_{collision}$, the times to collision $TTC_{long}$, $TTC_{lat}$, and/or the longitudinal factor $F_{long}$, as described above.

Next, in a block 535, the computing device 105 actuates one or more components 120 based on the threat number. For example, if the threat number is above 0.7, the computing device 105 can actuate a brake to decelerate the host vehicle 101, e.g., to −6.5 meters per second squared (m/s$^2$).

In another example, if the threat number is above 0.4 but less than or equal to 0.7, the computing device 105 can actuate the brake to, e.g., a deceleration of −2.0 m/s $^2$. In another example, if the threat number is greater than 0.2 but less than or equal to 0.4, the computing device 105 can display a visual warning on a vehicle 101 HMI and/or play an audio warning over a speaker. Following the block 535, the process 500 ends.

As used herein, the adverb "substantially" modifying an adjective means that a shape, structure, measurement, value, calculation, etc. may deviate from an exact described geometry, distance, measurement, value, calculation, etc., because of imperfections in materials, machining, manufacturing, sensor measurements, computations, processing time, communications time, etc.

Computing devices 105 generally each include instructions executable by one or more computing devices such as those identified above, and for carrying out blocks or steps of processes described above. Computer-executable instructions may be compiled or interpreted from computer programs created using a variety of programming languages and/or technologies, including, without limitation, and either alone or in combination, Java™, C, C++, Visual Basic, Java Script, Perl, HTML, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media. A file in the computing device 105 is generally a collection of data stored on a computer readable medium, such as a storage medium, a random access memory, etc.

A computer-readable medium includes any medium that participates in providing data (e.g., instructions), which may be read by a computer. Such a medium may take many forms, including, but not limited to, non-volatile media, volatile media, etc. Non-volatile media include, for example, optical or magnetic disks and other persistent memory. Volatile media include dynamic random access memory (DRAM), which typically constitutes a main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. For example, in the process 500, one or more of the steps could be omitted, or the steps could be executed in a different order than shown in FIG. 5. In other words, the descriptions of systems and/or processes herein are provided for the purpose of illustrating certain embodiments, and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non-provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

The article "a" modifying a noun should be understood as meaning one or more unless stated otherwise, or context requires otherwise. The phrase "based on" encompasses being partly or entirely based on.

The invention claimed is:

1. A system, comprising a computer including a processor and a memory, the memory storing instructions executable by the processor to:

determine a lateral time to collision and a longitudinal time to collision;

determine a distance offset, based on, a yaw rate, a relative lateral distance, a relative longitudinal distance, and at least one of the lateral time to collision or the longitudinal time to collision, between a target vehicle and a host vehicle;

determine a threat estimation based on the lateral time to collision, the longitudinal time to collision, the distance offset, and a distance threshold; and actuate a component of the host vehicle based on the threat estimation.

2. The system of claim 1, wherein the instructions further include instructions to actuate a brake when the threat estimation exceeds a threshold.

3. The system of claim 1, wherein the instructions further include instructions to determine the longitudinal distance offset based on the lateral time to collision and the lateral distance offset based on the longitudinal time to collision.

4. The system of claim 1, wherein the instructions further include instructions to determine the longitudinal distance threshold based on the lateral time to collision and the lateral distance threshold based on the longitudinal time to collision.

5. The system of claim 1, wherein the threat estimation is a brake threat number being a measure of a change in an acceleration of the host vehicle to allow one of the host vehicle to stop and the target vehicle to pass the host vehicle.

6. The system of claim 1, wherein the time to collision is based on an acceleration of the host vehicle, a velocity of the host vehicle, and a yaw rate of the host vehicle.

7. The system of claim 1, wherein the threat estimation is based on a first threat estimation of the host vehicle and a second threat estimation of the target vehicle.

8. The system of claim 1, wherein the time to collision is based on a predicted position of the target vehicle relative to the host vehicle at a predetermined time period after a current time.

9. A method, comprising:

determining a lateral time to collision and a longitudinal time to collision;

determining a distance offset, based on a yaw rate, a relative lateral distance, a relative longitudinal distance, and at least one of the lateral time to collision or the longitudinal time to collision, between a target vehicle and a host vehicle;

determining a threat estimation based on the lateral time to collision, the longitudinal time to collision, the distance offset, and a distance threshold; and actuating a component of the host vehicle based on the threat estimation.

10. The method of claim 9, further comprising actuating a brake when the threat estimation exceeds a threshold.

11. The method of claim 9, further comprising determining the longitudinal distance offset based on the lateral time to collision and the lateral distance offset based on the longitudinal time to collision.

12. The method of claim 9, further comprising determining the longitudinal distance threshold based on the lateral time to collision and the lateral distance threshold based on the longitudinal time to collision.

13. The method of claim 9, wherein the threat estimation is a brake threat number being a measure of a change in an acceleration of the host vehicle to allow one of the host vehicle to stop and the target vehicle to pass the host vehicle.

14. The method of claim 9, wherein the time to collision is based on an acceleration of the host vehicle, a velocity of the host vehicle, and a yaw rate of the host vehicle.

15. The method of claim 9, wherein the threat estimation is based on a first threat estimation of the host vehicle and a second threat estimation of the target vehicle.

16. The method of claim 9, wherein the time to collision is based on a predicted position of the target vehicle relative to the host vehicle at a predetermined time period after a current time.

* * * * *